United States Patent [19]

Sunshine

[11] Patent Number: 4,587,755

[45] Date of Patent: May 13, 1986

[54] PORTABLE CHANGEABLE LIGHTED SIGN

[76] Inventor: Richard B. Sunshine, 6835 Quarterway, Dallas, Tex. 75248

[21] Appl. No.: 569,314

[22] Filed: Jan. 9, 1984

[51] Int. Cl.[4] ..... G09F 13/04

[52] U.S. Cl. ..... 40/571; 40/572; 40/546

[58] Field of Search ..... 40/546, 574, 908, 571, 40/572

[56] References Cited

U.S. PATENT DOCUMENTS

| | | | |
|---|---|---|---|
| 278,630 | 5/1883 | Tessy | 40/571 |
| 422,256 | 2/1890 | Singleton | 40/572 |
| 1,698,357 | 1/1929 | Block | 40/571 |
| 1,751,564 | 3/1930 | Stone | 40/574 |
| 2,029,221 | 1/1936 | Burgess et al. | 40/574 |
| 2,129,651 | 9/1938 | Cunningham | 40/618 |
| 2,361,354 | 10/1944 | Regester | 40/571 |
| 2,612,548 | 9/1952 | Swanson | 340/84 |
| 2,634,530 | 4/1953 | Herschede et al. | 40/546 |
| 2,644,935 | 7/1953 | Greenwald | 40/546 |
| 3,254,436 | 6/1966 | Bank | 40/552 |
| 3,571,999 | 3/1971 | Downing | 40/908 |
| 4,042,919 | 8/1977 | Patty | 340/321 |
| 4,052,806 | 10/1977 | George | 40/572 |
| 4,062,139 | 12/1977 | Klosel | 40/533 |
| 4,140,405 | 2/1979 | Shapiro et al. | 40/552 |
| 4,387,520 | 6/1983 | Ahrens | 40/611 |

FOREIGN PATENT DOCUMENTS

| | | | |
|---|---|---|---|
| 697785 | 9/1940 | Fed. Rep. of Germany | 40/572 |

*Primary Examiner*—Robert Peshock
*Assistant Examiner*—Cary E. Stone
*Attorney, Agent, or Firm*—Richards, Harris, Medlock & Andrews

[57] ABSTRACT

A portable changeable sign is provided. The sign includes a base and a removably attached folded screen element constructed of translucent material. A source of light is disposed within the base to emit light to and through the screen element for illuminating a message disposed on an outer surface of the screen element.

1 Claim, 5 Drawing Figures

PORTABLE CHANGEABLE LIGHTED SIGN

TECHNICAL FIELD

The present invention relates to portable lighted display mechanisms and the like, and more particularly to a translucent plastic display panel mounted on a self contained plastic battery pack and light.

BACKGROUND ART

The use of signs to display messages is extensively used in many forms and for many reasons. Most signs are of a permanent nature as to their location and the messages they display.

There is a need for a portable sign apparatus that permits the ready changing of a displayed message. For example, there have been many incidents where persons with disabled vehicles were assaulted upon leaving the relative safety of their locked vehicle. A portable changeable sign would allow the motorist to call for help without leaving the vehicle.

Similarly, street repair and maintenance by its very nature creates hazards to the motorists and repair crews that could be averted with adequate warning. Traffic accidents create conditions that require the precise awareness by passing motorists of unusual hazards. Flares, cones and flagmen are inadequate for this purpose.

Serious floor hazards (wet floors, drop offs, etc.) and dangers inherent in high risk industrial areas (flammable, explosive, radioactive or otherwise toxic conditions) necessitate explicit and highly obvious or blatant warnings to passersby. There is no portable, changeable sign adapted for warning passersby of such hazards.

Retail stores and wholesale showrooms use conventional signs in their windows to state hours of operation and/or around their products to indicate price savings and other sales information. Presently available electric window signs require connection to permanent electric wiring.

It is thus apparent that a need presently exists for a sign that is self-contained, easily changeable and portable in nature.

SUMMARY OF THE INVENTION

The invention provides a new and useful improvement in the displaying of messages by improving the ease by which a sign may be handled and its message changed. The lightweight display mechanism, in its preferred form, consists of a folded one-piece semi-rigid screen element removably attached to a light emitting battery pack base. The components of the invention are lightweight and easily detached for transport and storage. The sign material is an electrostatically charged plastic strip which easily sticks to and peels off the screen element.

BRIEF DESCRIPTION OF THE DRAWINGS

A more complete understanding of the invention and its advantages will be apparent from the Detailed Description taken in conjunction with the accompanying Drawings in which.

DETAILED DESCRIPTION

Figure 1:
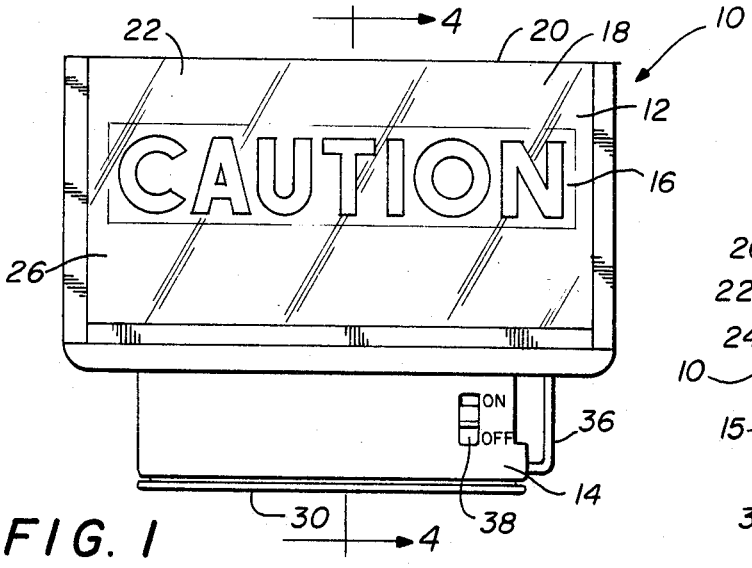
FIG. 1 is a frontal view of the sign.
Figure 2:
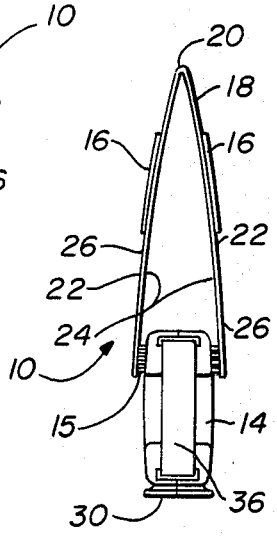
FIG. 2 is a side view of the sign of FIG. 1.

Referring initially to FIGS. 1 and 2, sign 10 includes screen element 12 attached to base 14. As best seen in FIG. 2, screen element 12 is connected to base 14 by means of fasteners 15. Message elements 16 are attached to screen element 12 by means of electrostatic adhesion.

Figure 3:
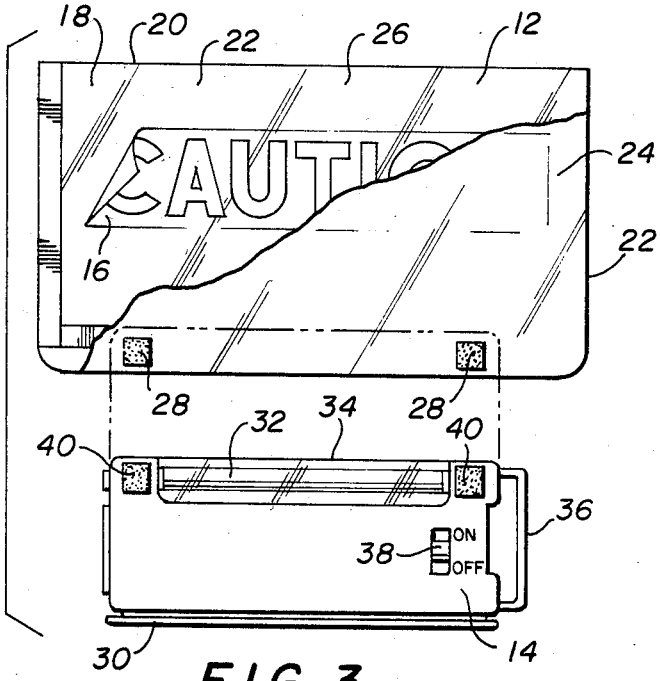
FIG. 3 is an exploded partially broken away frontal view of the sign of FIG. 1.

Referring now to FIGS. 1, 2 and 3, screen element 12 is constructed of a single piece of semi-rigid translucent plastic material 18. Material 18 is permanently folded along medial edge 20 thereof, forming two display panels 22 each having inner surfaces 24 and outer surfaces 26. Inside surfaces 24 are adjacent and facing each other. In preferred form, fasteners 15 are Velcro TM-type loop and hook fasteners. Attached to each inner surface 24 at the opposite and lower edge thereof are loop pieces 28 of fasteners 15.

Base 14 is constructed of a rigid plastic material having an elongate rectangular shape. Base 14 includes support surface 30 for vertically supporting base 14. Base 14 also includes light element 32, clear plastic lens 34, handle 36, and on/off switch 38. Attached to the upper side portions of base 14 and opposite each other are hook pieces 40 disposed to engage loop pieces 28 on screen element 12.

Figure 4:
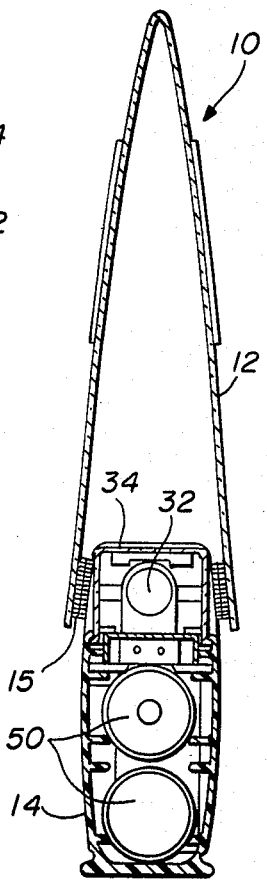
FIG. 4 is a sectional side view taken along lines 4—4 of FIG. 1.

Referring now to FIG. 4, disposed in base 14 is the power supply for illustrating sign 10. In preferred form, light element 32 is a fluorescent bulb, and the power supply includes four "D" size dry cells 50 connected to light element 32 through switch 38 in conventional manner. Preferably, circuitry (not shown) for periodically interrupting the power supply/light element connection is provided to enable the sign to flash.

Figure 5:
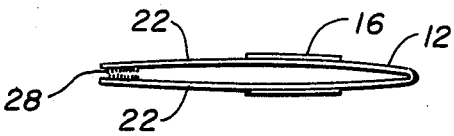
FIG. 5 is a side view of the screen element used with the sign of FIG. 1.

Referring now to FIG. 5, an important feature of the invention is that screen element 12, being manufactured of a permanently folded semi-rigid material, may be made to lie essentially flat after removal from base 14. In its folded condition, display panels 22 can be made to contact one another such that screen element 12 has minimum thickness.

In operation, sign 10 provides a portable illuminated sign that can be adapted to display a variety of messages. As shown in FIG. 3, message elements 16 may be easily peeled from screen element 12 and reattached at a later time. In preferred form, where message elements are attached to the screen element by means of electrostatic adhesion, individual message elements may be interchanged repeatedly.

A key feature of the invention is the use of semi-rigid plastic material in the construction of screen element 12. In storage, screen element 12 may be folded as shown in FIG. 5 to take up minimum space, yet be quickly deployed when the need arises. When deployed, screen element 12 is spread to the angled shape shown in FIGS. 1–4 and removably attached to base 14 by means of fasteners 15.

While a single embodiment of the present invention has been described in detail herein as shown in the accompanying Drawings, it will be evident that various further modifications are possible without departing from the scope of the invention.

I claim:

1. A portable changeable sign comprising:

an elongate rectangular base adapted to be vertically self-supporting along one side thereof;

a direct current power supply disposed within the base;

a fluorescent light tube disposed within the base;

the base further including a transparent lens adjacent the light tube;

a switch for selectively connecting the power supply to the light tube;

a screen element constructed of a single piece of semi-rigid translucent plastic material permanently creased along a medial edge thereof to form first and second display panels adapted for receiving light from the light tube and diffusing the light to a removable plastic message element disposed on an outer surface of at least one display panel, the display panels forming an acute angle at the medial edge when deployed with the lower edges of said panels spread for removable attachment to the elongate base, said panels being movable to a flat storage position when removed from the elongate base; and disengageable fastening material disposed upon opposite upper side portions of the elongate base and opposite lower inner portions of the first and second display panels.

* * * * *